United States Patent [19]
Peterson
[11] 4,242,794
[45] Jan. 6, 1981

[54] UNIVERSAL BLOWER ATTACHMENT UNIT

[76] Inventor: Clayton R. Peterson, 308 Avenida Santa Margarita, San Clementa, Calif. 92672

[21] Appl. No.: 15,630

[22] Filed: Feb. 27, 1979

[51] Int. Cl.[3] ..... B25F 3/00
[52] U.S. Cl. ..... 30/122; 30/276; 56/12.7
[58] Field of Search ..... 56/2, DIG. 9, 12.8, 56/13.4, 12.7; 415/119, 121 R, 219 R, 206; 416/146 R; 417/410, 423 R, 424; 30/276, 122

[56] References Cited

U.S. PATENT DOCUMENTS

| | | | |
|---|---|---|---|
| 2,777,271 | 1/1957 | Sutton . | |
| 3,332,611 | 7/1967 | Bednarski et al. | 415/206 |
| 3,441,089 | 4/1969 | Minton | 172/14 |
| 4,068,376 | 1/1978 | Briar | 56/12.7 X |

*Primary Examiner*—Jerry W. Myracle
*Attorney, Agent, or Firm*—Poms, Smith, Lande & Rose

[57] ABSTRACT

A universal blower unit is provided which may be directly attached to any of the most widely distributed flexible line type grass or weed trimming tools, known as "Line-Trimmers" and sold under various designations including under the trademark "WEED EATER". The blower unit is secured to the motor housing following removal of the unit which normally holds the line employed in the line trimming operation. In securing the blower unit in place, a series of spacing studs are employed to orient and prevent lateral movement of the blower unit, and spring clamps extend up over the housing to hold the blower unit onto the motor housing and to hold the impeller in driving engagement with the output drive shaft from the motor. A small supplemental impeller is located adjacent the motor for cooling purposes. The blower unit is spaced downwardly from the motor housing and air is drawn in through the space between the blower and the motor housings. A nozzle is provided to direct a jet of air forward from the blower apparatus to sweep sidewalks or other paved or unpaved surfaces free from clippings and the like.

19 Claims, 9 Drawing Figures

UNIVERSAL BLOWER ATTACHMENT UNIT

BACKGROUND OF THE INVENTION

This invention relates generally to a portable blower apparatus, and more specifically, to a new and improved blower apparatus for use with portable flexible line type grass or weed trimming devices.

In the field of grass or weed-cutting or trimming, large size units which are mounted on wheels and which both cut and blow the cuttings as desired are known, such as described in, for example, U.S. Pat. No. 2,777,271 to W. R. Sutton, granted Jan. 15, 1977, and U.S. Pat. No. 3,441,089 to E. D. Minton. In addition, gasoline motor operated backpack air compressor units with flexible hoses are known for blowing grass clippings and the like from sidewalks, lawns, and other surfaces. However, in addition to being relatively inconvenient to use, such units are relatively heavy and expensive thereby reducing their applications and usage.

Accordingly, a principal object of the present invention is to provide a lightweight and inexpensive blower apparatus, which may be employed to clear sidewalks or other paved or unpaved areas of grass, leaves, clippings, and the like, and which is relatively simple and convenient to use.

SUMMARY OF THE INVENTION

The present invention provides a new and improved blower apparatus which is inexpensive to manufacture, and reliable in use, and which attaches readily to a convenient flexible line grass or weed trimmer such as that sold under the trademark "WEED EATER". Moreover, the present invention is light in weight, safe in operation, and easy to use, thereby making the air blower apparatus of the invention relatively simple and convenient for substantially anyone to use.

More specifically, in accordance with a broad structural aspect of the invention, the air blower includes a lightweight housing releasably mounted to a flexible line grass or weed trimming device, and within which is enclosed an impeller coupled to the power shaft of the trimmer device. The housing is provided with at least one air inlet opening through which air is drawn by the impeller, and an outlet nozzle through which air is blown from the impeller.

The housing can be releasably secured to the trimmer device by any suitable means, such as a pair of spring clamps which, in cooperation with locating studs, are capable of securing the housing in operating position on any of several widely distributed flexible line type trimmers. Further, by this arrangement, the entire blower attachment can be easily and conveniently secured to or removed from the trimmer device in a single operation.

In order to provide air for cooling the trimmer motor, an upper air impeller can be arranged above the blower housing and driven by the trimmer motor. To provide for the lightweight and inexpensive manufacture of the present invention, the major components of the blower apparatus are preferably molded of high strength plastic materials.

Other features and advantages of the present invention will become apparent from the following detailed description, taken in conjunction with the accompanying drawings, which illustrate, by way of example, the principles of the invention.

DETAILED DESCRIPTION

Figure 1:
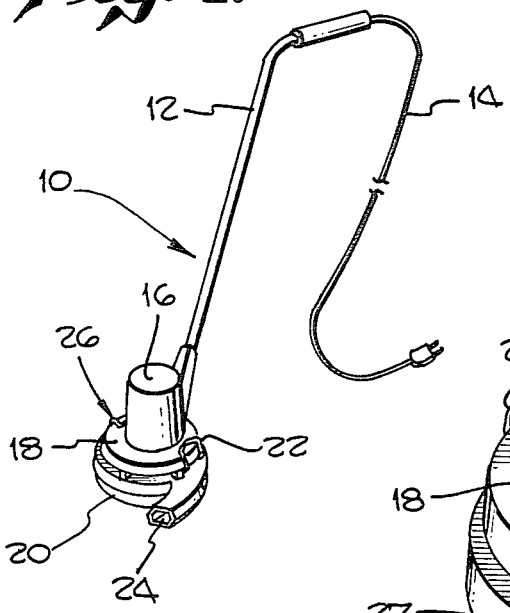
FIG. 1 is a perspective view of a line trimmer apparatus equipped with a blower illustrating the principles of the present invention.

Referring more particularly to the drawings, FIG. 1 shows a line trimmer, indicated generally by reference numeral 10, and illustrated as the general type shown in U.S. Pat. No. 4,054,992 which is provided with a handle 12, an electrical input cord 14, and a drive motor housing 16 having a lower flange 18. A blower attachment 20 illustrating the principles of the present invention is secured to the flange 18 of the motor housing 16 by locating studs and spring clamps including a clamp 22, as shown in FIG. 1.

Figure 2:
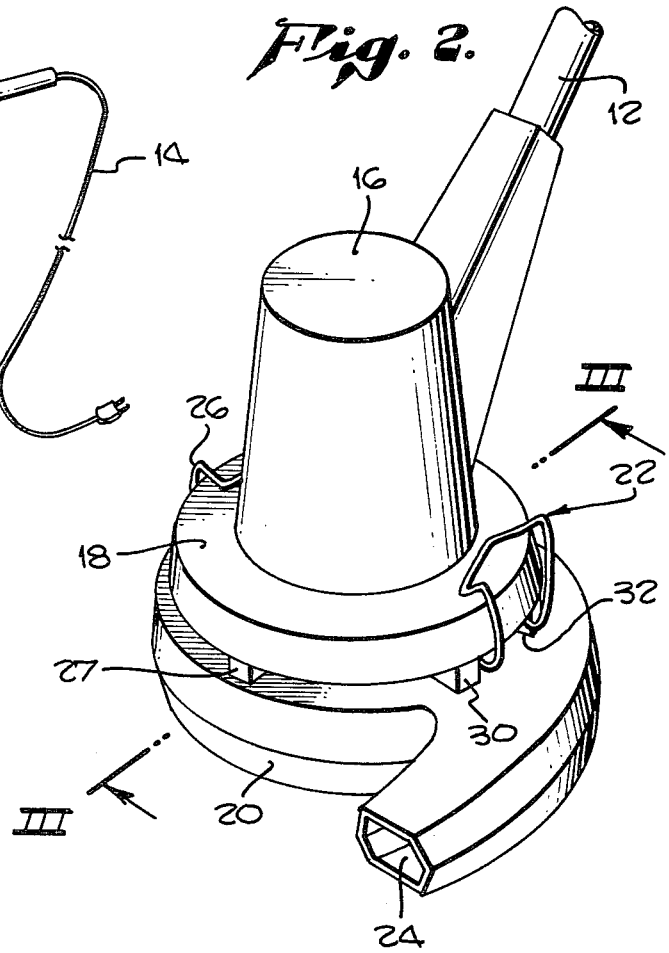
FIG. 2 is an enlarged, fragmentary perspective view of a motor housing and blower unit illustrating the principles of the present invention.

FIG. 2 is an enlarged view of the line trimmer motor housing 16, its lower flange 18, the blower 20, and the spring clamp 22, all as shown in FIG. 1. In FIG. 2, certain additional details may be observed, including the nozzle 24 from which a jet of air is expelled when the motor of the trimmer 10 is running, and the second spring retaining clamp 26 which is diametrically opposed to the spring 22. Also visible in FIG. 2 are three mounting and spacing studs 27, 30, and 32, which serve to space the blower assembly 20 from the flange 18 and to locate the two units relative to one another. Additional mounting studs are also employed but these are not shown in FIG. 2. Two of these additional studs are associated with the spring clamp 26, and serve to mount it, while a sixth stud 31 is located to the rear of the blower below the handle 12. In operation of the blower attachment 20, air is drawn in between the upper surface of the blower unit 20 and the flange 18, in the space provided by the mounting studs. To permit the air to enter the blower unit, a series of apertures 25 (FIG. 3) are formed through the top of the blower unit and arranged symmetrically about the central axis of the unit. After entering the blower unit through the apertures 25, the air is expelled, as mentioned above, through the nozzle 24.

Figure 3:
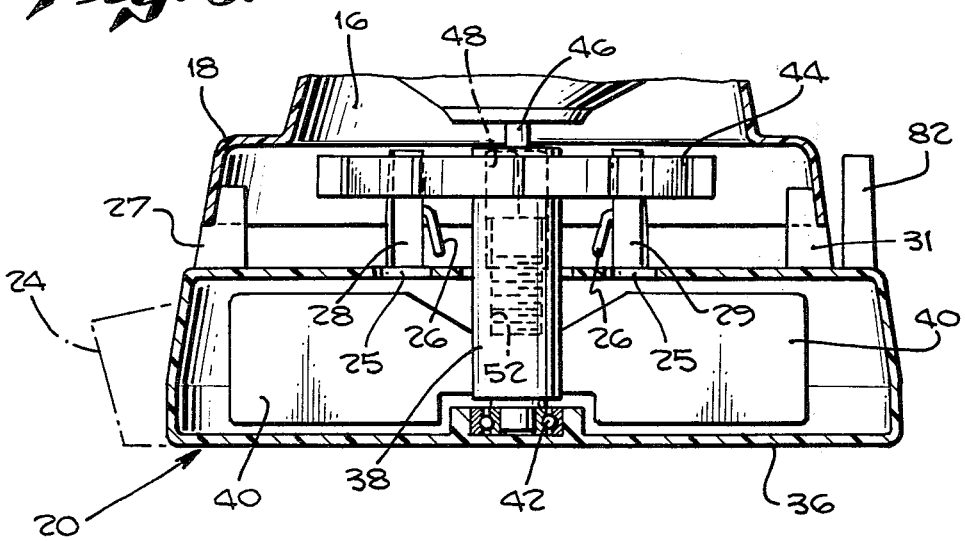
FIG. 3 is a further enlarged, partly sectional view of the blower unit, and illustrating the motor housing flange of a typical line trimmer.

Now, referring to FIG. 3, a partial cross-sectional view of the blower 20 is shown. As shown in FIG. 3, a housing 36 encloses a rotor having a central shaft 38 and a series of radially-extending impeller blades 40. The shaft 38 is mounted for rotation in the housing 36 by a bearing 42. A small impeller 44 is supported on the upper end of the shaft 38, to provide cooling for the electric motor (not shown) of the trimmer 10.

Figure 7:
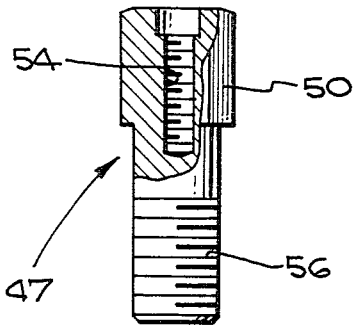
FIG. 7 is an elevational view of the drive nut which is employed as an output drive member in the widely distributed line trimmers, and which is also employed to drive the blower unit attachment as disclosed herein.

Extending downwardly from the trimmer motor is a threaded shaft 46 to which a fastener 47, having the form shown in FIG. 7, is secured. Accordingly, the upper end of the shaft 38 is provided with a hexagonal recess 48 which is dimensioned to receive and to be driven by the outer surface of the hexagonal head 50 of the fastener 47 as shown in FIG. 7. The central portion of the shaft 38 is recessed, as indicated at 52, to receive the lower end of the fastener 47. The shaft 46 from the motor is threaded into the inner tapped hole 54 in the fastener 47, with this inner tapped hole 54 being formed in a metal liner within the fastener. The lower threaded end 56 of the fastener 47 is normally used to hold the line holding unit which does the cutting, when the apparatus is used for trimming, but it is not utilized in the specific assembly illustrated in FIG. 3. Also shown in FIG. 3 are the two studs 28 and 29 which engage the lower edge of the flange 18 of the motor housing 16, and support the spring clamp 26.

Accordingly, the present invention provides a simple lightweight blower attachment which can be releasably secured to a flexible line type trimming device in a single convenient operation. That is, the above-described arrangement permits the blower attachment 20 to be secured below the trimmer housing 16 in a position whereby the shaft 38 engages the fastener 47 and is driven by the trimmer motor, while the blower housing 36 is held in a fixed position with respect to the trimmer housing 16. This fixed position can be spaced from the trimmer housing to permit air to be drawn in between the trimmer and blower housings for the purpose of cooling the trimmer motor and supplying air to the blower through the inlets 25.

It will be appreciated that the blower 20 of the present invention can be releasably secured to the trimmer housing 16 in any desired manner, such as by bolts or the like, so long as the blower is firmly held in operative position with respect to the housing, as described above. Further, it is highly desirable to be able to attach and remove the blower 20 to and from the housing 16 quickly and easily. Toward this end, the presently preferred structure for releasably securing the blower to the housing is by use of the spring clamps 22 and 26 which are similar to one another in construction and operation, and that construction and operation will be described in greater detail below in connection with FIGS. 5 and 6.

Figure 4:
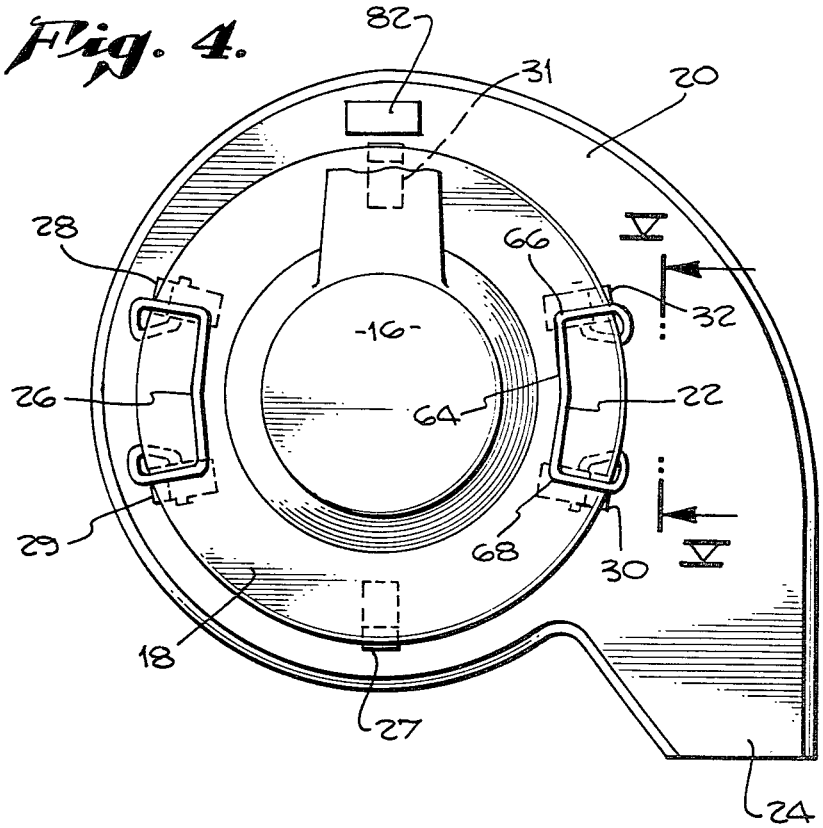
FIG. 4 is a fragmentary top view of the unit of FIG. 2.

FIG. 4 is a top view of the motor housing 16, its associated flange 18, the blower assembly 20 with its nozzle 24, and the associated spring clamps 22 and 26 which, in the presently preferred embodiment of the invention, hold the blower in its assembled position relative to the motor housing 16 and flange 18.

Figure 5:
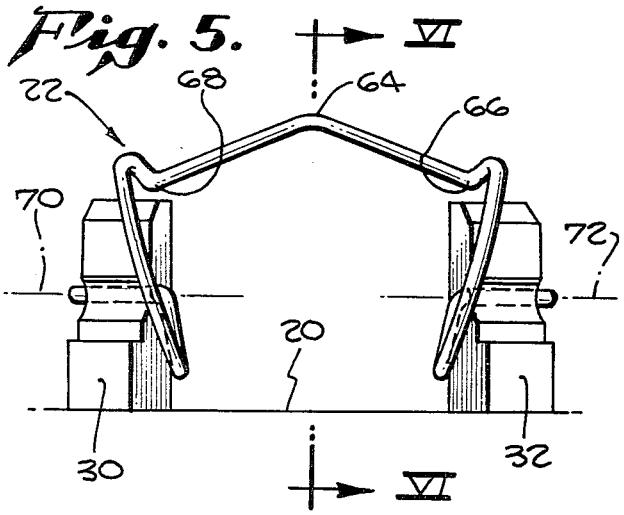
FIG. 5 is a fragmentary side view of the blower unit of FIG. 4 without the motor in place, taken generally along line V—V of FIG. 4, and illustrating two of the locating studs and one of the spring clamps which are employed in mounting the blower unit to the motor housing.
Figure 6:
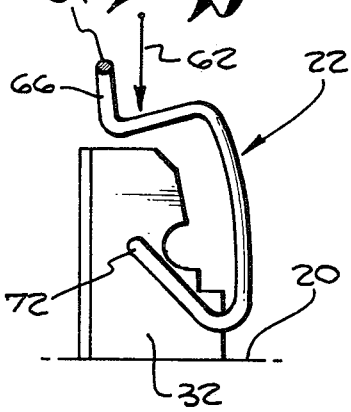
FIG. 6 is a fragmentary, partly sectional view of one of the mounting studs and the mounting spring, taken generally along lines VI—VI of FIG. 5.

FIG. 5 is a side view of the mounting studs 30 and 32 which are secured to the top of the blower assembly 20, together with the spring 22 which is prestressed and bent into the configuration shown in FIGS. 5 and 6 (and also FIG. 3 which shows the matching spring 26). Incidentally, the spring clamp 22 is of high strength, very springy wire, and is strongly biased in the direction indicated by the arrow 62 as shown in FIG. 6. The spring 22 has a high point at its center 64, and, when in the locking position, bears firmly against the top of the flange 18 at the two points 66 and 68. The spring clamps 22 and 26 are mounted on the studs 30 and 32 by the ends of the springs being received through apertures in the mounting studs, which apertures are not aligned with one another, as indicated by the dashed lines 70 and 72 in FIGS. 5 and 9.

Figure 8:
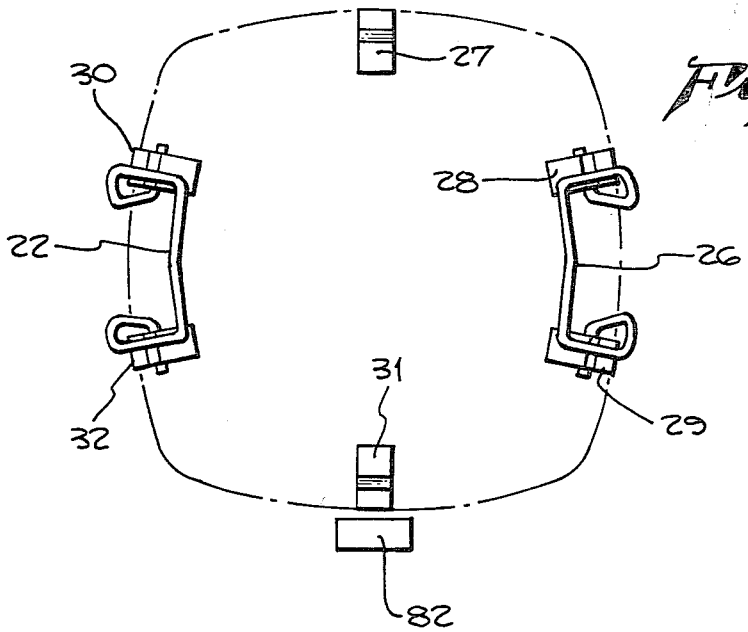
FIGS. 8 and 9 illustrate alternative line trimmer housings to which the blower attachment of the present invention can be secured.

As shown in FIGS. 1 through 4, for example; the flange 18 associated with the motor housing 16 is substantially circular in its configuration. In addition to the circular flange configuration as shown in these Figures of the drawings, certain other widely distributed line trimming devices having housings with flanges of the configurations shown in FIGS. 8 and 9 of the drawings. More specifically, as shown in FIG. 8 of the drawings, one widely distributed unit has a slightly more square base; however, as may be seen from the superposition of the studs 27, 28, 29, 30, 31 and 32, the unit will still be accommodated by the same mounting arrangements which were employed in securing the blower unit 20 to the circular flange 18 associated with motor 16 of FIG. 2.

Figure 9:
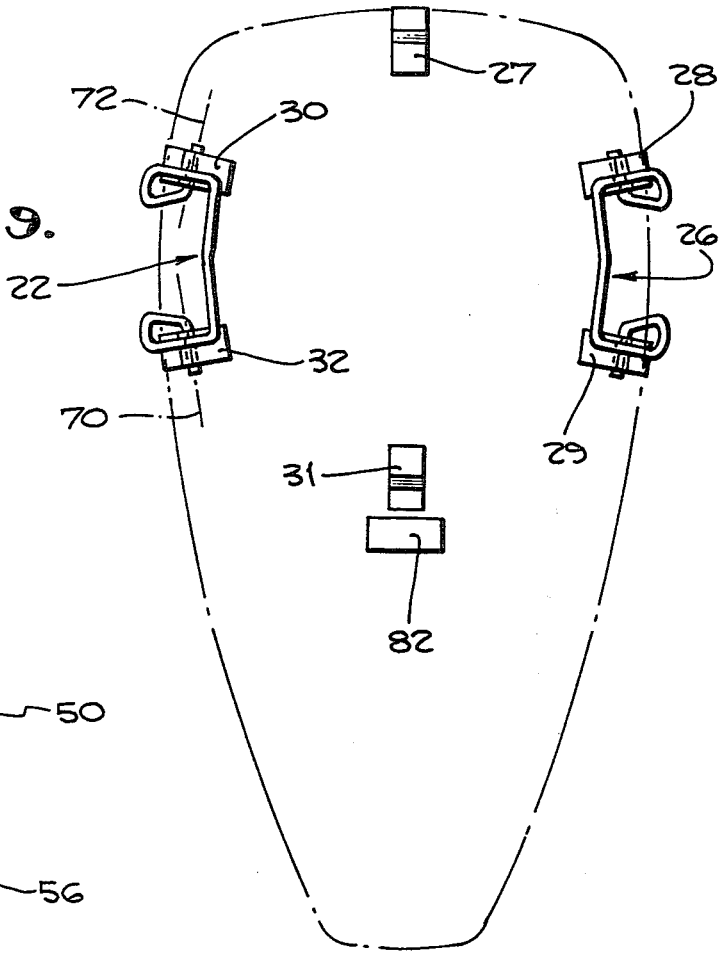

Also, the same arrangements of studs and spring clips may be employed to mount the blower unit 20 to the form of motor flange shown in FIG. 9 which is also widely used. In the case of the motor housing flange as outlined in FIG. 9, an additional supporting stud 82 bears on the lower inner surface of the elongated housing, and avoids vibration which might otherwise occur. It may be noted in passing that the stud 82, which also appears in FIG. 3 and FIG. 8 of the drawings, lies outside of the flange in these other embodiments of the invention. Accordingly, with the stud arrangements as disclosed herein, and with the two spring clamps which grip the flange on its two sides, a universal blower attachment is provided which may be employed readily in any of the widely distributed versions of the line trimmer.

Incidentally, one interesting feature of the invention involves the fact that the impeller in the blower unit of the present invention is efficiently operated at the same rate of rotation as the line trimmer, so that complicated speed changing arrangements are not necessary.

In closing, it is to be understood that the embodiments of the invention disclosed herein are illustrative of the principles of the invention. Other modifications may be employed which are within the scope of the invention; thus, by way of example but not of limitation, the rotor shaft 38 may be directly secured to the downwardly-extending threads 56 of the fastener 47, other air inlet may be used, and alternative securing arrangements, such as wing nuts, toggle clamps, or other resilient or quick releasable clamps, may be provided for the blower unit 20. It is to be understood, however, that the single unitary assembly of universal applicability, as shown in the illustrative form of the invention is to be preferred. Accordingly, the present invention is not limited to that precisely as shown and described in the present specification.

I claim:

1. A blower attachment for a line trimmer including a trimmer housing and drive shaft; said attachment comprising:

a blower housing having an air inlet and an air outlet said blower housing being secured in a position spaced from said trimmer housing, and said inlet being disposed between said blower housing and said trimmer housing;

an impeller mounted for rotation in said blower housing and having means coupling said impeller to said drive shaft for moving air from said inlet to and out of said outlet, said impeller including a shaft extending out of said blower housing toward said trimmer, said shaft carrying a second impeller outside of said blower housing for providing cooling air to said trimmer; and means for releasably securing said blower housing to said trimmer housing in a position placing said receiving means on said impeller in operative connection with said drive shaft.

2. A blower attachment for a line trimmer including a trimmer housing having an outwardly extending flange at the lower edge thereof, and a drive shaft; said attachment comprising:

a blower housing having an air inlet and an air outlet;

an impeller mounted for rotation in said blower housing and having means coupling said impeller to said drive shaft for moving air from said inlet to and out of said outlet; and means for releasably securing said blower housing to said trimmer housing in a position placing said receiving means on said impeller in operative connection with said drive shaft, said means for releasably securing said blower housing to said trimmer housing including at least one spring clamp on said blower housing, said spring clamp being arranged to releasably grip said flange between said blower housing and said spring clamp.

3. A blower attachment as set forth in claim 2 wherein a pair of said spring clamps are arranged on said blower housing for releasably securing a plurality of different configurations of trimmer housing flanges.

4. A blower attachment for securing to a line trimmer housing; said trimmer comprising:

an impeller;

a blower housing enclosing said impeller and having a nozzle extending from said blower housing;

means for supplying air to said blower housing from above said blower housing;

means for quickly detaching and securing said blower housing to said trimmer housing; and means for mounting said impeller for driving engagement with a motor of said line trimmer and for rotation within said blower housing to blow air out through said nozzle.

5. A blower attachment as defined in claim 4 wherein said quick detaching means includes resilient clamping means.

6. A blowing attachment as defined in claim 5 wherein said resilient clamping means includes at least one metal spring clamp.

7. A line trimmer and blower attachment assembly comprising:

a line trimmer unit including a handle, a motor, and a motor housing with the rotating line holder removed;

an impeller unit having a series of radially extending blades;

a blower housing enclosing said impeller unit, said blower housing including a nozzle;

means for firmly securing said blower housing to said motor housing; and means for mounting said impeller unit for rotational driving engagement with said motor to blow air out through said nozzle.

8. An assembly as defined in claim 7 wherein said securing means includes resilient clamping means.

9. An assembly as defined in claim 8 wherein said resilient clamping means includes at least one metal spring clamp.

10. An assembly as defined in claim 7 wherein said securing means includes a plurality of spacing studs and at least two spring clamps.

11. A blower attachment for securing to the motor housing flange of a line trimmer comprising:

an impeller;

a blower housing enclosing said impeller, said blower housing having a nozzle extending outwardly therefrom;

an inlet means for supplying air to said blower housing, said air inlet means having an inlet opening above said blower housing;

means secured to said blower housing for engaging the lower edge and the sides of said motor housing flange to prevent lateral movement of said blower housing with respect to said motor housing flange;

means for applying mechanical force between said blower housing and said motor housing flange for holding them firmly together; and means for mounting said impeller for driving engagement with a motor of said line trimmer, and for rotation within said blower housing to blow air out through said nozzle.

12. A blower attachment as defined in claim 11 wherein said means for holding said blower housing and said motor housing flange together includes quick detachable means for applying a resilient force between said blower housing and said motor housing flange.

13. A universal blower attachment for line trimming apparatus comprising:

a unitary blower assembly including a blower housing, a central air impeller unit, and bearing means mounting said impeller in said blower housing, said impeller unit being provided with a recess means for driving by a motor of the line trimmer;

means including a plurality of studs mounted on the upper surface of said blower unit to space and locate said blower housing relative to a lower flange of a motor housing; and resilient means for clamping said blower housing to said flange of said motor housing.

14. A blower attachment as defined in claim 13 wherein two spring clamps are provided, one on either side of said blower assembly, whereby a plurality of different configurations of line trimmer motor housings may be accommodated.

15. A blower attachment for line trimming as defined in claim 13 wherein said resilient clamping means includes a pair of spring clamps each being mounted on a pair of said studs.

16. A blower attachment as defined in claim 13 for line trimmers having motor housings which have a predetermined lateral dimension of the motor housing from the motor axis to the front and to the two sides, and a predetermined motor housing flange depth, wherein pairs of said studs are located at the sides of said blower assembly, and at least one of said studs is located at the front of said blower assembly, with the distance of each of said five studs from the central axis of said blower assembly being substantially equal to said lateral dimensions.

17. A blower attachment as defined in claim 16 further comprising an additional vibration damping stud mounted at the rear of said blower housing at a distance slightly greater than said lateral dimension to engage motor housings having a rearwardly extending flange while avoiding interference with line trimmers having a rear extent substantially equal to said predetermined lateral dimension.

18. A blower attachment for securing to a line trimmer housing; said attachment comprising:

an impeller;

a blower housing enclosing said impeller and having a nozzle extending from said blower housing;

means for supplying air to said blower housing from above the level of said nozzle extending from said blower housing;

means for quickly detaching and securing said blower housing to said trimmer housing; and means for mounting said impeller for driving engagement with a motor of said line trimmer and for rotation within said blower housing to blow air out through said nozzle.

19. A line trimmer and blower attachment assembly comprising:

a line trimmer unit including a handle, a motor, and a motor housing with the rotating line holder removed;

an impeller unit having a series of radially extending blades;

a blower housing enclosing said impeller unit;

a nozzle extending outwardly from said blower housing;

means for firmly securing said blower housing to said motor housing; and means for mounting said impeller unit for rotational driving engagement with said motor to blow air out through said nozzle.

* * * * *